US011302505B2

(12) United States Patent
Kang et al.

(10) Patent No.: US 11,302,505 B2
(45) **Date of Patent: *Apr. 12, 2022**

(54) CIRCUIT PROTECTION DEVICE

(71) Applicant: SMART ELECTRONICS INC., Ulsan (KR)

(72) Inventors: Doo Won Kang, Gyeonggi-do (KR); A Lam Shin, Busan (KR)

(73) Assignee: SMART ELECTRONICS INC., Ulsan (KR)

( * ) Notice: Subject to any disclaimer, the term of this patent is extended or adjusted under 35 U.S.C. 154(b) by 21 days.

This patent is subject to a terminal disclaimer.

(21) Appl. No.: 17/015,150

(22) Filed: Sep. 9, 2020

(65) Prior Publication Data

US 2021/0090838 A1 Mar. 25, 2021

(30) Foreign Application Priority Data

Sep. 23, 2019 (KR) ..... 10-2019-0117006

(51) Int. Cl.
*H01H 85/143* (2006.01)
*H01C 7/04* (2006.01)
*H01H 85/165* (2006.01)

(52) U.S. Cl.
CPC ..... *H01H 85/143* (2013.01); *H01C 7/04* (2013.01); *H01H 85/165* (2013.01)

(58) Field of Classification Search
CPC ..... H01H 85/143; H01H 85/165; H01H 85/0052; H01H 85/055; H01C 7/04; H02H 5/042
See application file for complete search history.

(56) References Cited

U.S. PATENT DOCUMENTS 4,644,316 A * 2/1987 Takeuchi ..... G05D 23/2401 219/544
5,153,555 A * 10/1992 Enomoto ..... H01C 1/1406 338/22 R (Continued)

FOREIGN PATENT DOCUMENTS

JP 2001102146 A * 4/2001
JP 2002-184282 A 6/2002

(Continued)

OTHER PUBLICATIONS

Odakura Yasunori, "Method of Connecting Terminals", Hitachi Ltd., Hitachi Car Eng Co Ltd, Apr. 13, 2001, Entire Document (Translation of JP 2001102146). (Year: 2001).*

(Continued)

*Primary Examiner* — Stephen S Sul
(74) *Attorney, Agent, or Firm* — Harness, Dickey & Pierce, P.L.C.

(57) ABSTRACT

Disclosed is a circuit protection device including a case, a first negative temperature coefficient thermistor which is accommodated in the case and includes a first resistant heating element, a pair of electrodes installed on both sides of the first resistant heating element, and a first lead wire and a second lead wire withdrawn from the pair of electrodes, respectively, a thermal fuse which is accommodated in the case and includes a thermal fuse body and a third lead wire and a fourth lead wire connected to both ends of the thermal fuse body, respectively, and a second negative temperature coefficient thermistor which is accommodated in the case and includes a second resistant heating element, a pair of electrodes installed on both sides of the second resistant heating element, and a fifth lead wire and a sixth lead wire withdrawn from the pair of electrodes, respectively.

3 Claims, 8 Drawing Sheets

(56) References Cited

U.S. PATENT DOCUMENTS

| | | | | |
|---|---|---|---|---|
| 5,708,553 | A * | 1/1998 | Hung | H01C 7/13 337/114 |
| 5,933,019 | A * | 8/1999 | Depue | G01R 1/07392 324/754.08 |
| 5,945,903 | A * | 8/1999 | Reddy | H01H 85/0417 337/197 |
| 7,728,709 | B2 * | 6/2010 | Grunbichler | H01C 7/126 337/4 |
| 2009/0121822 | A1 * | 5/2009 | Jeong | H01C 7/123 338/20 |
| 2010/0118505 | A1 * | 5/2010 | Marten | H05K 3/368 361/803 |
| 2010/0182727 | A1 * | 7/2010 | Hebibasi | H04M 1/745 361/118 |
| 2012/0032774 | A1 * | 2/2012 | Jung | H01H 69/02 337/414 |
| 2012/0038450 | A1 * | 2/2012 | Jung | H01H 85/175 337/184 |
| 2012/0075762 | A1 * | 3/2012 | Wang | H02H 9/026 361/93.8 |
| 2017/0214292 | A1 * | 7/2017 | Nagahama | H02K 1/12 |
| 2021/0104884 | A1 * | 4/2021 | Kang | H01C 1/022 |

FOREIGN PATENT DOCUMENTS

| | | | |
|---|---|---|---|
| JP | 2010-157410 | A | 7/2010 |
| KR | 101434136 | B1 * | 8/2014 |

OTHER PUBLICATIONS

Mori Yashuhiro, "Fuse Resistor", Teikoku Tsushin Kogyo KK, Jul. 15, 2010, Entire Document (Translation of JP 2010157410) (of record, cited in the IDS, including Original Document). (Year: 2010).*

Kang Doo Won, "Circuit Protecting Device", Smart Electronics Inc., Aug. 27, 2014, Entire Document (Translation of KR 101434136). (Year: 2014).*

Office Action from corresponding Korean Patent Application No. 10-2019-0117006, dated Aug. 25, 2020.

* cited by examiner

CIRCUIT PROTECTION DEVICE

CROSS-REFERENCE TO RELATED APPLICATION

This application claims priority to and the benefit of Korean Patent Application No. 2019-0117006, filed on Sep. 23, 2019, the disclosure of which is incorporated herein by reference in its entirety.

FIELD

The present invention relates to a circuit protection device, and more particularly, to a circuit protection device configured to restrict an inrush current when an electronic product is initially driven and to prevent fire caused by an increase in internal temperature or an overcurrent.

BACKGROUND

In general, in an electric circuit of a large electronic product such as an air conditioner, a washer, a refrigerator, a dryer, or the like, a circuit protection device is provided at a power input terminal of the electric circuit and protects a power circuit to prevent a failure caused by an inrush current, an increase in internal temperature, a continuous overcurrent, and the like which occur when power is turned on.

FIGS. 1A and 1B illustrate components and operations of an existing circuit protection device. The existing circuit protection device includes a fuse resistor RF, a first relay S1 connected to the fuse resistor RF in a series, and a second relay S2 connected to the fuse resistor RF and the first relay S1 in parallel. The fuse resistor RF includes a resistor R and a thermal fuse F, and the resistor R and the thermal fuse F are connected to each other in series.

In the circuit protection device, state (a) in which the first relay S1 is closed and the second relay S2 is opened at a driving time is converted into state (b) in which the first relay S1 is opened and the second relay S2 is closed after a certain time.

In state (a), an input current passes through the fuse resistor RF and the first relay S1 and is input to an electrical circuit. Here, when the resistor R limits an inrush current to a certain current and an overcurrent flows thereinto, heat generated by the resistor R is conducted to the thermal fuse F and a fused body including solid lead or polymer pellets provided inside the thermal fuse F is fused to short-circuit a circuit so as to protect an electrical circuit of a home appliance. After a certain time (for example, about 0.5 seconds) in which the inrush current disappears and the input current is stabilized, the circuit protection device is changed to state (b) so that a normal input current is input to the electrical circuit via the second relay S2.

Since the circuit protection device includes three components including the fuse resistor RF and the first relay S1 and the second relay S2 which have a relatively great volume, costs are high and a larger space is occupied. Also, a normal input current is within a range from 2 A to 4 A in the case of a washer and is 7 A or higher in the case of a dryer. Accordingly, it is necessary to use high-current relays for the first relay S1 and the second relay S2. Here, since the high-current relays are high-priced and there are less commercialized domestic goods, most high-current relays have to be imported from Japan and the like.

In addition, since operations of the first relay S1 and the second relay S2 being opened or closed are repetitively performed whenever an electronic product is turned on or off, as the electronic product is used for a long time, durability thereof decreases and a malfunction occurs. The malfunctions of the first relay S1 and the second relay S2 may cause an inflow of an overcurrent or even cause fire. Accordingly, such risks are inherent all the time in the circuit protection device using relays.

SUMMARY

The present invention is directed to providing a circuit protection device capable of replacing a circuit protection device, which includes a fuse resistor RF, a first relay S1, and a second relay S2, as well as reducing costs and less occupying a space without using relays.

Aspects of the present invention are not limited to the above-stated aspects and other unstated aspects of the present invention will be understood by those skilled in the art from a following description.

According to an aspect of the present invention, there is provided a circuit protection device including a case, a first negative temperature coefficient thermistor which is accommodated in the case and includes a first resistant heating element, a pair of electrodes installed on both sides of the first resistant heating element, and a first lead wire and a second lead wire withdrawn from the pair of electrodes, respectively, a thermal fuse which is accommodated in the case and includes a thermal fuse body and a third lead wire and a fourth lead wire connected to both ends of the thermal fuse body, respectively, and a second negative temperature coefficient thermistor which is accommodated in the case and includes a second resistant heating element, a pair of electrodes installed on both sides of the second resistant heating element, and a fifth lead wire and a sixth lead wire withdrawn from the pair of electrodes, respectively. Here, the second lead wire and the third lead wire are connected to each other and the fourth lead wire and the fifth lead wire are connected to each other in the case.

The circuit protection device may further include a first pin connected to the first lead wire and a second pin connected to the sixth lead wire. Here, a first guide groove configured to guide the first pin to be withdrawn outward from the case and a second guide groove configured to guide the second pin to be withdrawn outward from the case may be formed in the case.

The first pin and the second pin may include plate-shaped bodies having one sides connected to the first lead wire and the sixth lead wire, respectively, and each include at least one extending portion extending from the other side of the body with a width smaller than that of the body.

The bodies of the first pin and the second pin may include first parts having one sides connected to the first lead wire and the sixth lead wire and inserted into the first guide groove and the second guide groove, respectively, and include second parts extending from other sides of the first parts with a width greater than that of the first parts and withdrawn outward from the case.

The case may include a partition wall extending from an inner wall of the case and disposed among the thermal fuse body, the first resistant heating element, and the second resistant heating element.

The circuit protection device may include a first cable having one end connected to the first lead wire and a second cable having one end connected to the sixth lead wire. Here, a first guide groove configured to guide the first cable to be withdrawn outward from the case and a second guide groove configured to guide the second cable to be withdrawn outward from the case may be formed in the case.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1A:
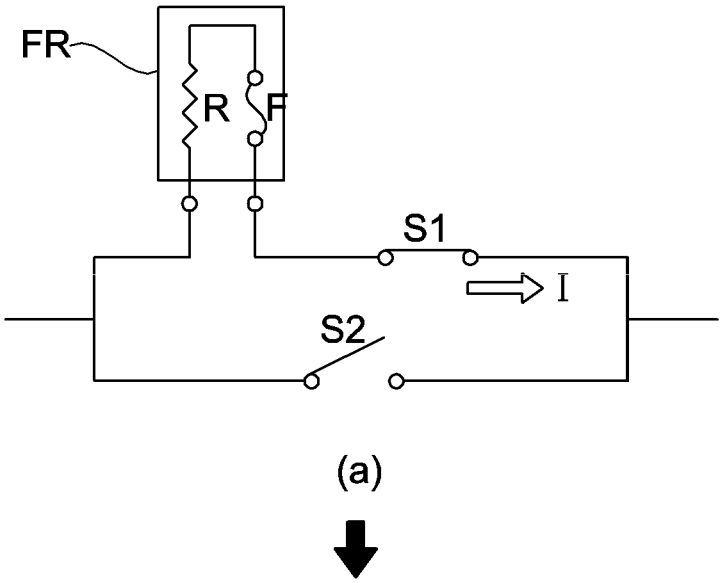
Prior Art FIG. 1A
FIGS. 1A and 1B illustrate components and operations of an existing circuit protection device.

Hereinafter, exemplary embodiments of the present invention will be described in detail with reference to the drawings. Hereinafter, throughout the description and the attached drawings, substantially like elements will be referred to as like reference numerals and a repetitive description thereof will be omitted. Also, in a description of the embodiments of the present invention, a detailed description of well-known functions or components of the related art will be omitted when it is deemed to obscure understanding of the embodiments of the present invention.

Figure 2:
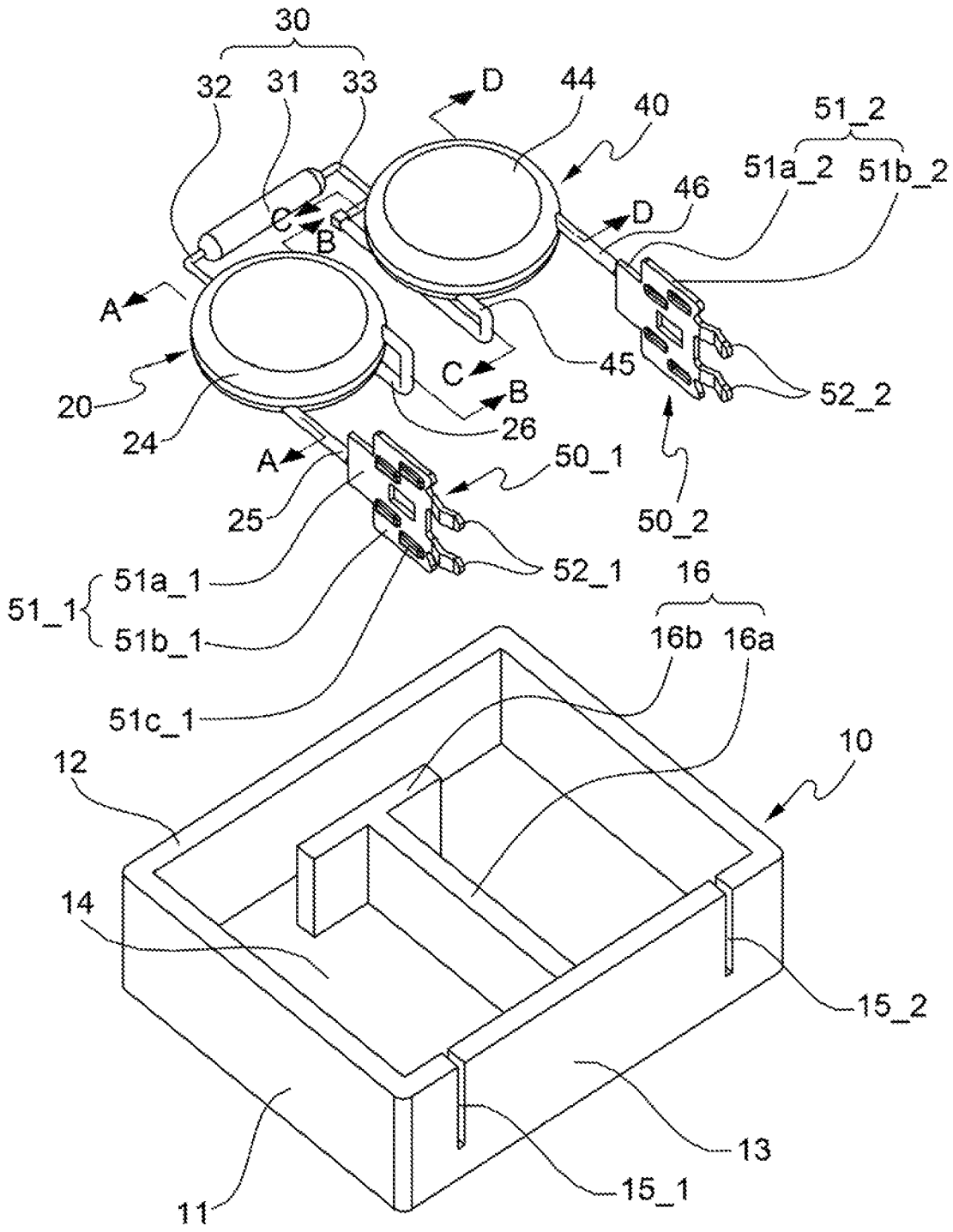
FIG. 2 is a perspective view of a circuit protection device according to a first embodiment of the present invention.
Figure 5:
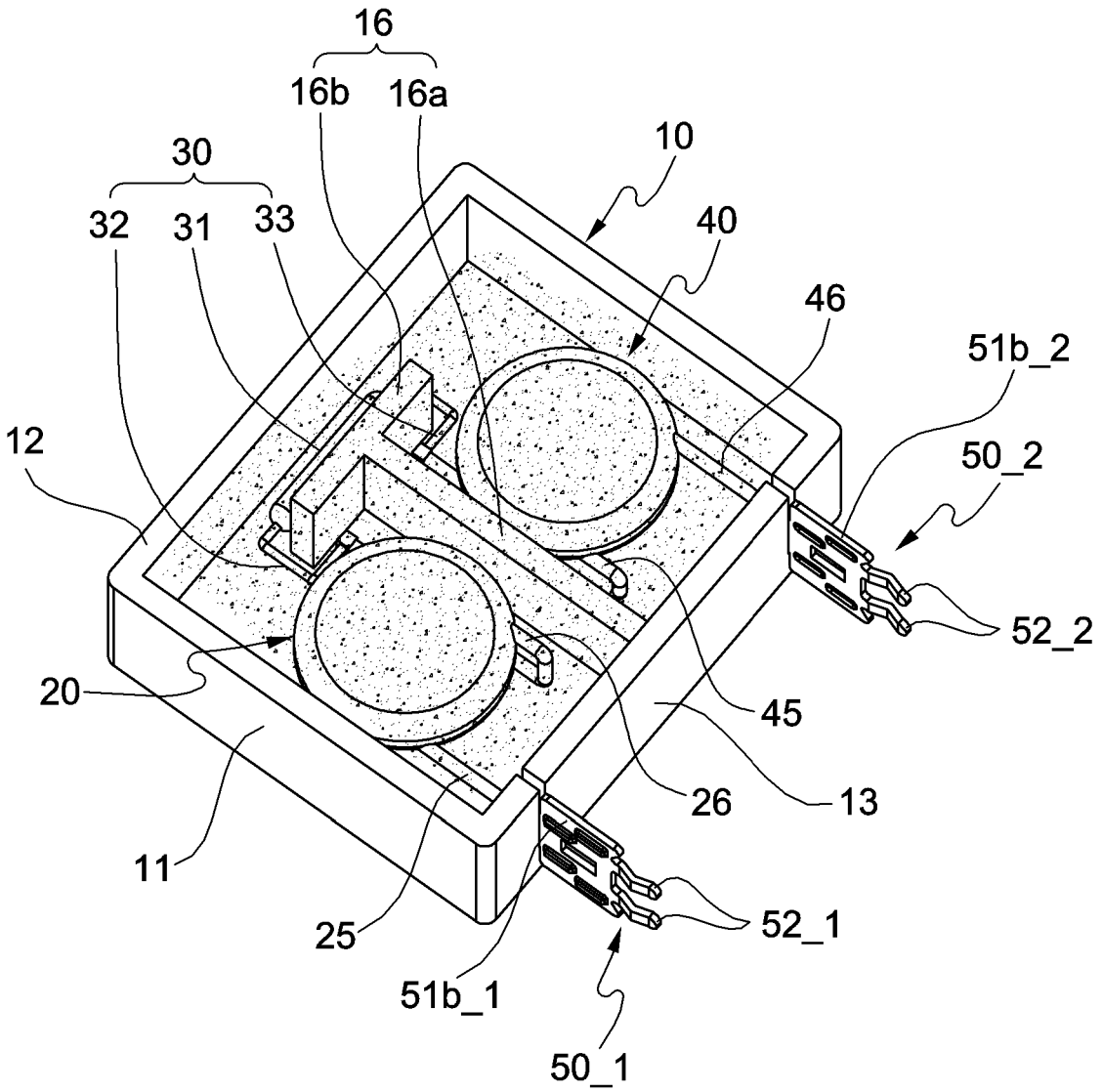
FIG. 5 is a perspective view illustrating a state in which a case 10 accommodates the negative temperature coefficient thermistors 20 and 40, a thermal fuse 30, and the like which are shown in FIG. 2 and then is filled with a filler.

FIGS. 2 to 5 are views illustrating components of a circuit protection device according to a first embodiment of the present invention. FIG. 2 is a perspective view of the circuit protection device according to the first embodiment. FIGS. 3A and 3B are cross-sectional views illustrating a first negative temperature coefficient thermistor 20 taken along lines A-A and B-B, respectively. FIGS. 4C and 4D are cross-sectional views illustrating a second negative temperature coefficient thermistor 40 taken along lines C-C and D-D, respectively. FIG. 5 is a perspective view illustrating a state in which a case 10 accommodates the negative temperature coefficient thermistors 20 and 40, a thermal fuse 30, and the like which are shown in FIG. 2 and then is filled with a filler.

The circuit protection device according to the first embodiment of the present invention includes the case 10, the first negative temperature coefficient thermistor 20, the thermal fuse 30, the second negative temperature coefficient thermistor 40, a first pin 50_1, and a second pin 50_2.

The case 10 includes, for example, a ceramic material and includes both sidewalls 11 and a front wall 12, a rear wall 13, and a bottom wall 14 so as to form an accommodation groove with an open top in which the first negative temperature coefficient thermistor 20, the thermal fuse 30, and the second negative temperature coefficient thermistor 40 are accommodated. A first guide groove 15_1 and a second guide groove 15_2 are formed on the rear wall 13 to guide the first pin 50_1 and the second pin 50_2 to be withdrawn outward from the case 10, respectively.

Figure 3A:
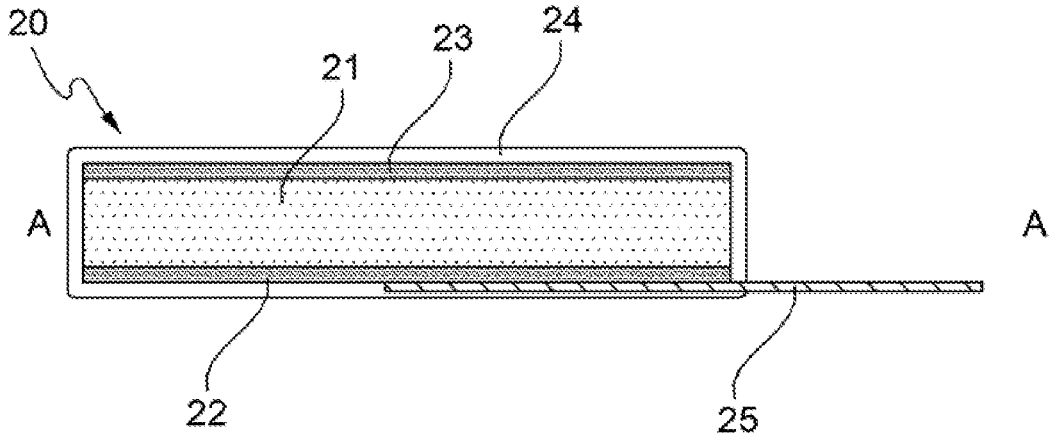
FIGS. 3A and 3B are cross-sectional views illustrating a first negative temperature coefficient thermistor 20 taken along lines A-A and B-B, respectively.
Figure 3B:
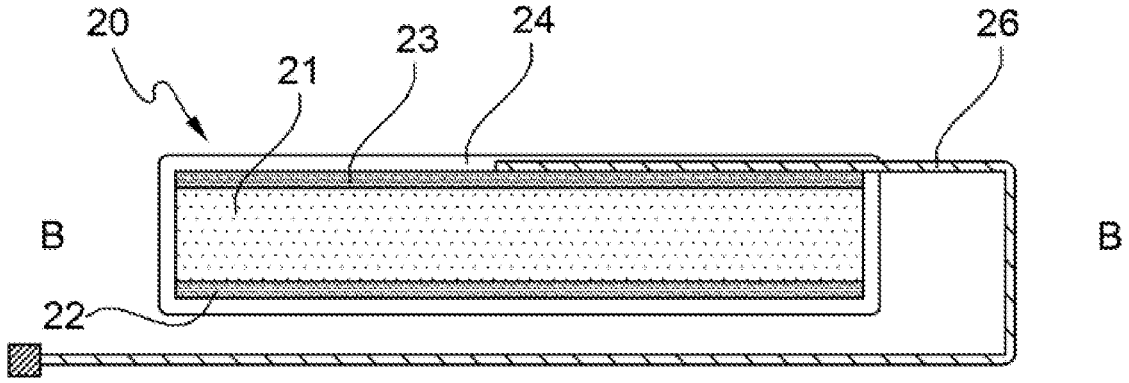
Figure 4C:
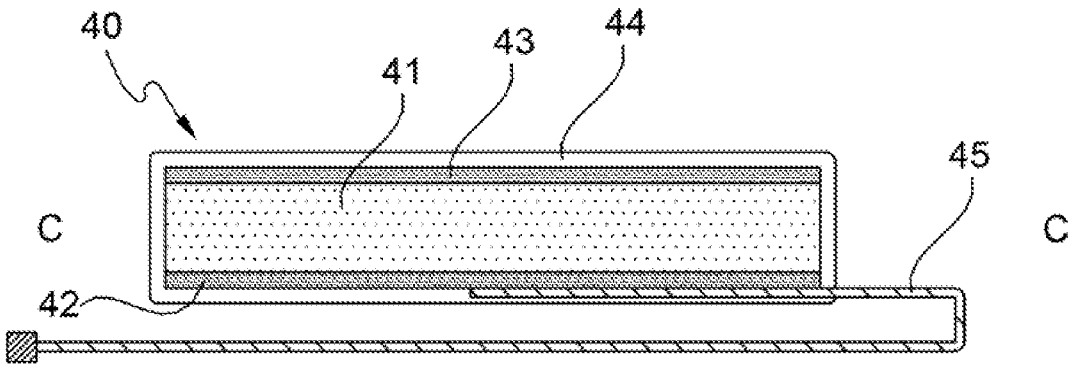
FIGS. 4C and 4D are cross-sectional views illustrating a second negative temperature coefficient thermistor 40 taken along lines C-C and D-D, respectively.
Figure 4D:
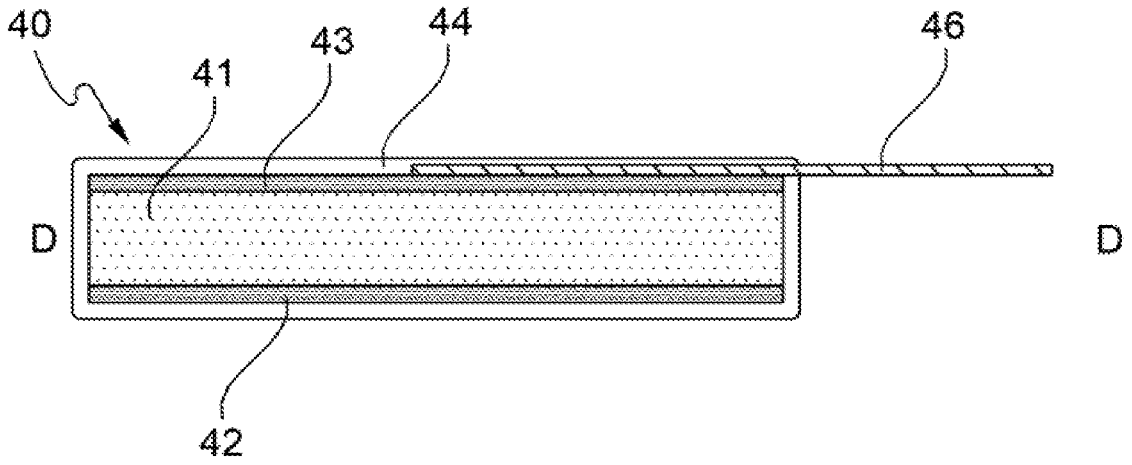

As shown in FIGS. 2 to 3B, the first negative temperature coefficient thermistor 20 includes a first resistant heating element 21, a pair of electrodes 22 and 23 installed on both sides of the first resistant heating element 21, a first lead wire 25 and a second lead wire 26 withdrawn from the pair of electrodes 22 and 23, respectively, which are coated with a coating material 24.

A thermistor is a resistor element having a sensitively varying thermal resistance value and particularly has a feature in which an electrical resistance value varies according to a change of a temperature thereof or an ambient temperature. Among such thermistors, a thermistor having a negative temperature coefficient is referred to as a negative temperature coefficient thermistor. The negative temperature coefficient thermistor has a resistance value which decreases according to an increase in a temperature thereof or an ambient temperature.

The thermal fuse 30 includes a thermal fuse body 31 and a third lead wire 32 and a fourth lead wire 33 connected to both ends of the thermal fuse body 31, respectively. Generally, the thermal fuse body 31 includes an insulating ceramic rod having a certain length and a fused body, and the third lead wire 32 and the fourth lead wire 33 may be connected to conductive caps installed respectively on both ends of the ceramic rod.

As shown in FIGS. 2, 4A, and 4B, the second negative temperature coefficient thermistor 40 includes a second resistant heating element 41, a pair of electrodes 42 and 43 installed on both sides of the second resistant heating element 41, a fifth lead wire 45 and a sixth lead wire 46 withdrawn from the pair of electrodes 42 and 43, respectively, which are coated with a coating material 44.

As shown in FIG. 2, the second lead wire 26 of the first negative temperature coefficient thermistor 20 and the third lead wire 32 of the thermal fuse body 30 are connected to each other. The second lead wire 26 may be bent and extend to be connectable to the third lead wire 32 of the thermal fuse 30. Also, the fourth lead wire 33 of the thermal fuse 30 and the fifth lead wire 45 of the second negative temperature coefficient thermistor 40 are connected to each other. The fifth lead wire 45 may be bent and extend to be connectable to the fourth lead wire 33. Connection between the second lead wire 26 and the third lead wire 32 and connection between the fourth lead wire 33 and the fifth lead wire 45 may be performed through soldering, arc welding, spot welding, laser soldering, clamping, or the like.

Meanwhile, the first pin 50_1 and the second pin 50_2, which are conductive materials and connected to a circuit board, are provided to perform electrical connection between a circuit and the circuit protection device. The first pin 50_1 has one end connected to the first lead wire 25 of the first negative temperature coefficient thermistor 20 in the case 10 and extends through the first guide groove 15_1 such that the other end thereof is withdrawn outward from the case 10. The second pin 50_2 has one end connected to the sixth lead wire 46 of the second negative temperature coefficient thermistor 40 in the case 10 and extends through the second guide groove 15_2 such that the other end thereof is withdrawn outward from the case 10.

In the embodiment of the present invention, the first pin 50_1 and the second pin 50_2 perform a function of performing electrical connection between the circuit and the circuit protection device, a function of emitting heat generated from the circuit protection device, and a function of spacing the case 10 at a certain interval apart from the circuit board when the circuit protection device is mounted on the circuit board.

The first pin 50_1 and the second pin 50_2 may include plate-shaped bodies 51_1 and 51_2 and extending portions 52_1 and 52_2 which extend from the bodies 51_1 and 51_2 with widths smaller than those of the bodies 51_1 and 51_2. Generally, the extending portions 52_1 and 52_2 are parts which are inserted into holes of the circuit board and soldered to perform electrical connection, and the bodies 51_1 and 51_2 are parts configured to emit heat and space the case 10 at a certain interval apart from the circuit board.

In detail, the first pin 50_1 may include the body 51_1 having one side connected to the first lead wire 25 and the extending portion 52_1 extending from the other side of the body 51_1 with a width smaller than that of the body 51_1. The second pin 50_2 may include the body 51_2 having one side connected to the sixth lead wire 46 and the extending portion 52_2 extending from the other side of the body 51_2 with a width smaller than that of the body 51_2. The first lead wire 25, the sixth lead wire 46, and the bodies 51_1 and 51_2 may be connected through soldering, arc welding, spot welding, laser soldering, clamping, or the like.

Also, the bodies 51_1 and 51_2 may include first parts **51*a*_1 and 51*a*_2 which have a relatively small width and second parts 51*b*_1 and 51*b*_2 which have a relatively great width. Generally, the first parts 51*a*_1 and 51*a*_2 are parts connected to the lead wires 25 and 46 and inserted into the guide grooves 15_1 and 15_2, and the second parts 51*b*_1 and 51*b*_2 are parts which are withdrawn outward from the case 10 so as to space the case 10 at a certain interval apart from the circuit board. Also, the second parts 51*b*_1 and 51*b*_2 may each include one or more protruding portions 51*c*** which improve heat dissipation performance.

In detail, the body 51_1 of the first pin 50_1 includes the first part **51*a*_1 having one side connected to the first lead wire 25 and inserted into the first guide groove 15_1 and the second part 51*b*_1 extending from the other side of the first part 51*a*_1 with a width greater than that of the first part 51*a*_1 and withdrawn outward from the case 10. The body 51_2 of the second pin 50_2 includes the first part 51*a*_2 having one side connected to the sixth lead wire 46 and inserted into the second guide groove 15_2 and the second part 51*b*_2 extending from the other side of the first part 51*a*_2 with a width greater than that of the first part 51*a*_2 and withdrawn outward from the case 10**.

Meanwhile, since the negative temperature coefficient thermistors 20 and 40 and the thermal fuse 30 are disposed to be adjacent to one another in a sealed space inside the case 10 such that a temperature of the circuit protection device or an ambient temperature thereof increases, the thermal fuse 30, which should not be short-circuited, may be short-circuited by heat generation of the negative temperature coefficient thermistors 20 and 40. Accordingly, a partition wall 16 may be installed among the thermal fuse body 31 and the resistant heating elements 21 and 41 of the negative temperature coefficient thermistors 20 and 40 so as to maintain a certain interval or more among the thermal fuse body 31 and the resistant heating elements 21 and 41. The partition wall 16 may extend from an inner wall of the case 10, for example, the rear wall 13. The partition wall 16 is installed not to completely separate spaces in which the resistant heating elements 21 and 41 are accommodated from a space in which the thermal fuse body 31 is accommodated so as to form paths through which the second lead wire 26 and the third lead wire 32 extend and form paths through which the fourth lead wire 33 and the fifth lead wire 45 extend. In one embodiment, the partition wall 16 may include a first partition wall **16*a* extending from the rear wall 13 and a second partition wall 16*b* extending from an end of the first partition wall 16*a* both ways and having a width approximately corresponding to a length of the thermal fuse body 31**.

Referring to FIG. 5, the case 10 is filled with a filler 80 while accommodating the negative temperature coefficient thermistors 20 and 40, the thermal fuse 30, and the like. The filler 80 not only supports the negative temperature coefficient thermistors 20 and 40 and the thermal fuse 30 inside the accommodation grooves but also enables heat to be effectively dissipated from the negative temperature coefficient thermistors 20 and 40 and the thermal fuse 30. Accordingly, the filler 80 may include a material having a high heat dissipation property.

Figure 6:
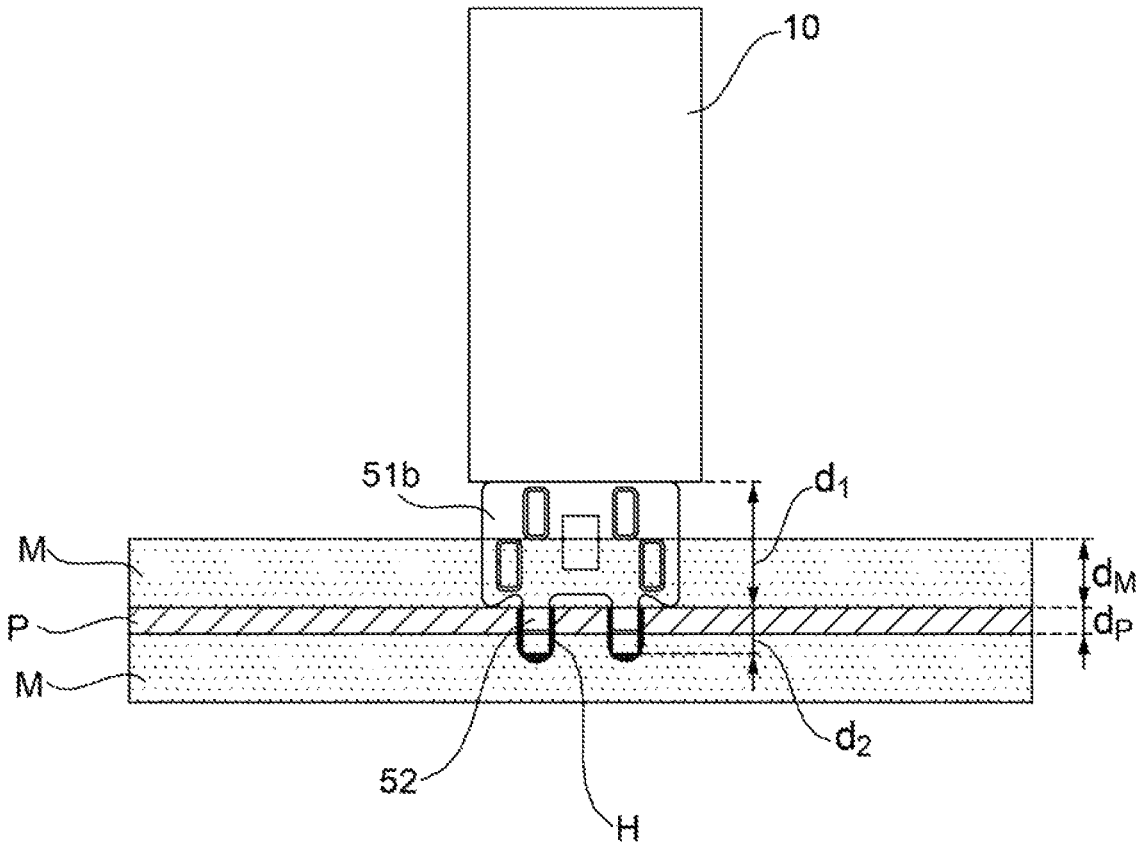
FIG. 6 illustrates a state in which the circuit protection device according to the first embodiment of the present invention is mounted on a circuit board.

FIG. 6 illustrates a state in which the circuit protection device according to the first embodiment of the present invention is mounted on a circuit board P.

Referring to FIG. 6, extending portions 52 of a pin 50 of a circuit protection device are inserted into to pass through holes H formed in the circuit board P and soldered so that the circuit protection device is fixed to the circuit board P and electrically connected to an electrical circuit on the circuit board P. Accordingly, a length d2 of the extending portions 52 is formed to be greater than a thickness dP of the circuit board P.

Meanwhile, in the case of an electronic product such as a washer or a dryer to which water is supplied or from which water is generated, the circuit board P includes a molding portion M having a waterproof material such as urethane and the like to protect the circuit board P from water. Since the molding portion M is relatively vulnerable to heat, when heat generated from the circuit protection device is transferred directly to the molding portion M, the molding portion M may be melted and waterproof performance thereof may be degraded. Accordingly, it is necessary to install the case 10 of the circuit protection device to be spaced at a certain interval apart from the circuit board P or the molding portion M. In the pin 50, a second part **51*b* of a body 51 which is withdrawn outward from the case 10 of the circuit protection device is installed so that the case 10 is spaced at a certain interval apart from the circuit board P or the molding portion M. The case 10 is spaced as much as a height d1 of the second part 51*b* apart from the circuit board P. When a thickness of the molding portion M is referred to as dM, the case 10** is spaced as much as d1-dM apart from the molding portion M. Accordingly, d1 may be greater than dM. Also, the molding portion M diffuses heat from the circuit protection device so as to assist heat dissipation.

Figure 7:
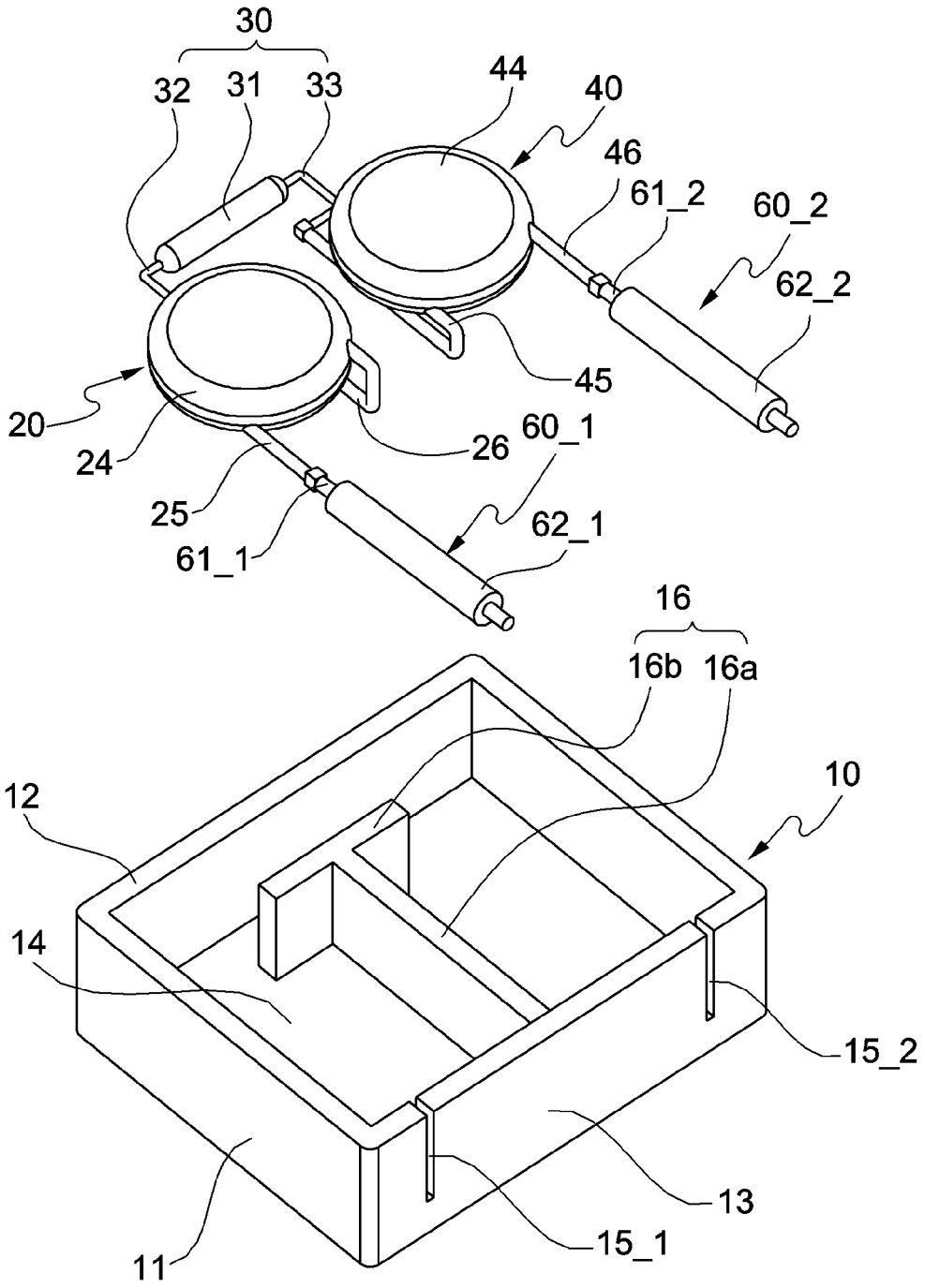
FIG. 7 is a perspective view of a circuit protection device according to a second embodiment of the present invention.
Figure 8:
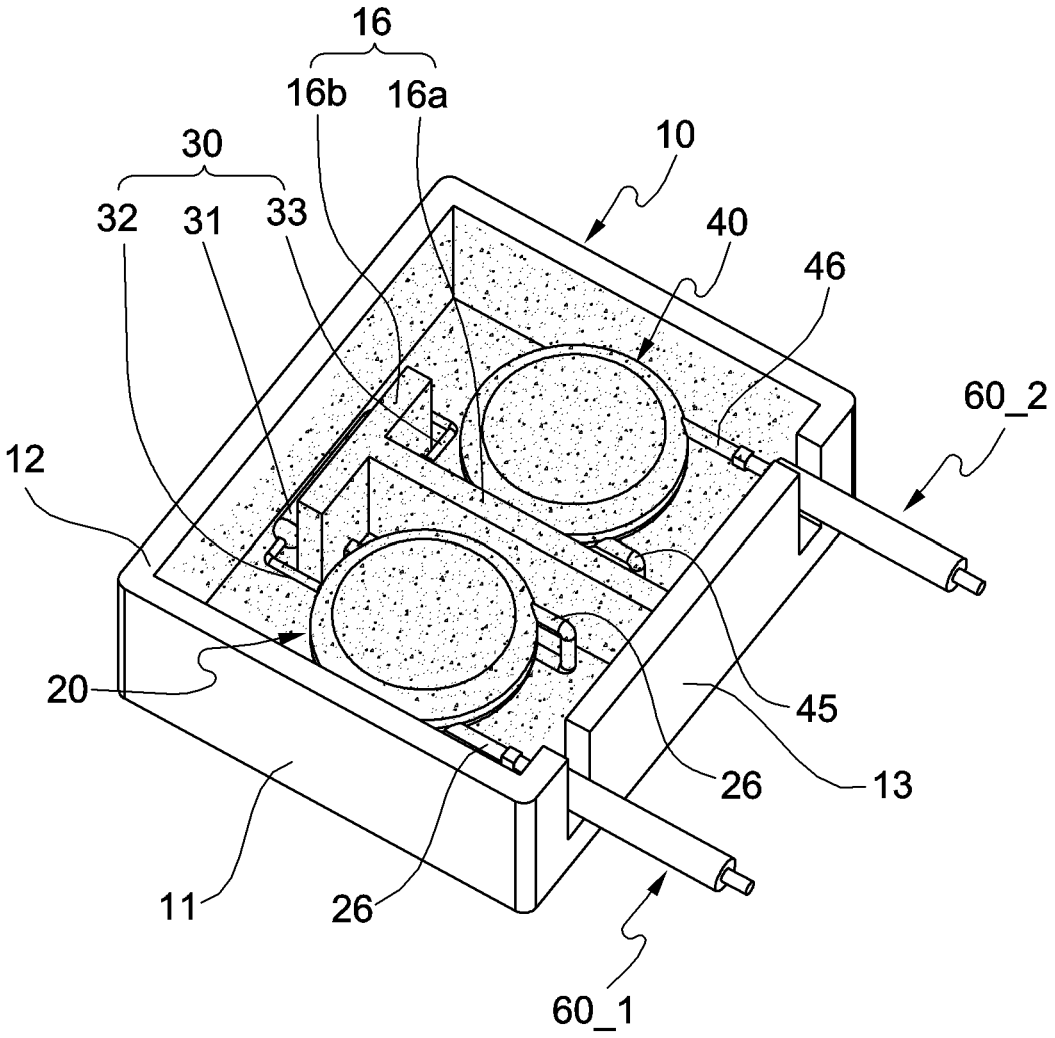
FIG. 8 is a perspective view illustrating a state in which a case 10 accommodates negative temperature coefficient thermistors 20 and 40, a thermal fuse 30, and the like which are shown in FIG. 7 and then is filled with a filler.

FIGS. 7 to 8 are views illustrating components of a circuit protection device according to a second embodiment of the present invention. FIG. 7 is a perspective view of the circuit protection device according to the second embodiment. FIG. 8 is a perspective view illustrating a state in which a case 10 accommodates negative temperature coefficient thermistors 20 and 40, a thermal fuse 30, and the like which are shown in FIG. 7 and then is filled with a filler.

In the second embodiment, in comparison to the first embodiment, the first pin 50_1 and the second pin 50_2 are replaced with a first cable 60_1 and a second cable 60_2, respectively. That is, in the second embodiment, the circuit protection device is implemented not to be installed directly on the circuit board and to be installed separately from a circuit board and connected to a corresponding terminal of the circuit board using the first cable 60_1 and the second cable 60_2. For convenience, in the second embodiment, a redundant description overlapped with the first embodiment will be omitted.

The first cable 60_1 and the second cable 60_2 include conducting wires 61_1 and 61_2 and coatings 62_1 and 62_2 enclosing the conducting wires 61_1 and 61_2, respectively. The first cable 60_1 and the second cable 60_2 may be harness cables.

The first cable 60_1 has one end of the conducting wire 60_1 connected to the first lead wire 25 of the first negative temperature coefficient thermistor 20 in the case 10 and extends through the first guide groove 15_1 such that the other end thereof is withdrawn outward from the case 10. The second cable 60_2 has one end of the conducting wire 61_2 connected to the sixth lead wire 46 of the second negative temperature coefficient thermistor 40 in the case 10 and extends through the second guide groove 15_2 such that the other end thereof is withdrawn outward from the case 10.

Since the circuit protection device according to the second embodiment is installed separately from the circuit board, there is an advantage in which heat generated at the circuit protection device is not transferred to the circuit board at all.

Figure 1B:
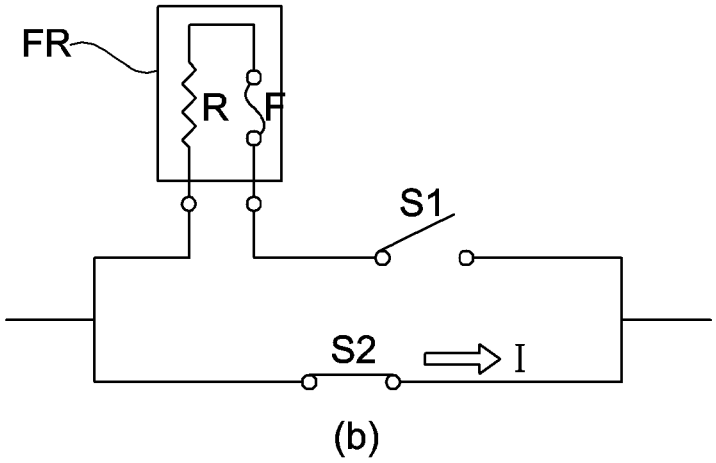
Prior Art FIG. 1B

According to the embodiments of the present invention, since the negative temperature coefficient thermistors 20 and 40 have a resistance value which is great at room temperature or a relatively low temperature and decreases according to an increase in a temperature thereof or an ambient temperature, an inrush current is limited to a certain current using a great resistance value at driving time and a normal input current is maintained using a resistance value decreasing due to an increase in temperature after a certain time. Simultaneously, when the negative temperature coefficient thermistors 20 and 40 are overheated by an overcurrent caused by an abnormal phenomenon in a circuit or an ambient temperature abnormally increases, the thermal fuse 30 short-circuits and cuts off an inflow of current so as to prevent fire. Accordingly, the circuit protection device according to the embodiments can replace an existing circuit protection device shown in FIGS. 1A and 1B. Also, since the negative temperature coefficient thermistors 20 and 40 have a relatively small volume and are low-priced in comparison to high-current relays, a cost of the circuit protection device may be reduced and a space may be less occupied. Also, since relays are not used, it is possible to fundamentally remove a risk element caused by malfunctions of the relays.

A circuit protection device according to the present invention can replace a circuit protection device including a fuse resistor RF, a first relay S1, and a second relay S2. Since the circuit protection device includes a negative temperature coefficient thermistor and a thermal fuse which are low-priced, costs may be reduced. The negative temperature coefficient thermistor and the thermal fuse have a small volume and less occupy a space in comparison to relays. Also, since the relays are not used, it is possible to fundamentally remove a risk of an overcurrent or fire caused by a malfunction of the relays.

The exemplary embodiments of the present invention have been described above. It should be understood by one of ordinary skill in the art that the present invention may be implemented as a modified form without departing from the essential features of the present invention. Therefore, the disclosed embodiments should be considered not in a limitative view but a descriptive view. The scope of the present invention will be shown in the claims not in the above description, and all differences within an equivalent range thereof should be construed as being included in the present invention.

What is claimed is:

1. A circuit protection device comprising:

a case;

a first negative temperature coefficient thermistor which is accommodated in the case and comprises a first resistant heating element, a pair of electrodes installed on both sides of the first resistant heating element, and a first lead wire and a second lead wire withdrawn from the pair of electrodes, respectively;

a thermal fuse which is accommodated in the case and comprises a thermal fuse body and a third lead wire and a fourth lead wire connected to both ends of the thermal fuse body, respectively;

a second negative temperature coefficient thermistor which is accommodated in the case and comprises a second resistant heating element, a pair of electrodes installed on both sides of the second resistant heating element, and a fifth lead wire and a sixth lead wire withdrawn from the pair of electrodes, respectively;

a first pin comprising a plate-shaped body having one side connected to the first lead wire and at least one extending portion extending from another side of the plate-shaped body of the first pin, wherein a width of the at least one extending portion of the first pin is smaller than that of the plate-shaped body of the first pin; and a second pin comprising a plate-shaped body having one side connected to the sixth lead wire and at least one extending portion extending from another side of the plate-shaped body of the second pin, wherein a width of the at least one extending portion of the second pin is smaller than that of the plate-shaped body of the second pin, wherein a first guide groove configured to guide the first pin to be withdrawn outward from the case, and a second guide groove configured to guide the second pin to be withdrawn outward from the case are formed in the case, and wherein the second lead wire and the third lead wire are connected to each other, and the fourth lead wire and the fifth lead wire are connected to each other in the case.

2. The circuit protection device of claim 1, wherein:

the plate-shaped body of the first pin comprises a first part having one side connected to the first lead wire and inserted into the first guide groove, and a second part extending from another side of the first part of the first pin;

a width of the second part of the first pin is greater than that of the first part of the first pin;

the second part of the first pin is withdrawn outward from the case;

the plate-shaped body of the second pin comprises a first part having one side connected to the sixth lead wire and inserted into the second guide groove, and a second part extending from another side of the first part of the second pin;

a width of the second part of the second pin is greater than that of the first part of the second pin; and the second part of the second pin is withdrawn outward from the case.

3. The circuit protection device of claim 1, wherein the case comprises a partition wall extending from an inner wall of the case and disposed among the thermal fuse body, the first resistant heating element, and the second resistant heating element.

* * * * *